US005342170A

United States Patent [19]

Elvekjaer et al.

[11] Patent Number: 5,342,170

[45] Date of Patent: Aug. 30, 1994

[54] AXIAL-FLOW TURBINE

[75] Inventors: Peter Elvekjaer, Baden; Walter Schreiber, Nussbaumen, both of Switzerland

[73] Assignee: Asea Brown Boveri Ltd., Baden, Switzerland

[21] Appl. No.: 83,265

[22] Filed: Jun. 29, 1993

[30] Foreign Application Priority Data

Aug. 29, 1992 [DE] Fed. Rep. of Germany ..... 4228879

[51] Int. Cl.[5] ..... F01D 9/02

[52] U.S. Cl. ..... 415/192; 415/191; 415/208.1; 416/223 A

[58] Field of Search ..... 415/181, 191, 192, 208.1, 415/208.2; 416/223 A, 238

[56] References Cited

U.S. PATENT DOCUMENTS

| | | | |
|---|---|---|---|
| 2,795,373 | 6/1957 | Hewson | 415/181 |
| 4,131,387 | 12/1978 | Kazin et al. | 416/223 A |
| 4,585,395 | 4/1986 | Nourse et al. | 415/181 |
| 4,682,935 | 7/1987 | Martin | 415/181 |
| 5,088,892 | 2/1992 | Weingold et al. | 415/193 |
| 5,249,922 | 10/1993 | Sato et al. | 416/223 A |

FOREIGN PATENT DOCUMENTS

| | | | |
|---|---|---|---|
| 179838 | 1/1907 | Fed. Rep. of Germany . | |
| 3743738A1 | 7/1988 | Fed. Rep. of Germany . | |
| 267506 | 11/1991 | Japan | 415/208.2 |
| 54203 | 2/1992 | Japan | 416/223 A |
| 124406 | 4/1992 | Japan | 416/223 A |
| 2199379 | 7/1988 | United Kingdom | 415/181 |

OTHER PUBLICATIONS

"Untersuchung und Berechnung axialer Turbinenstufen", Naumann, et al., 1973.

*Primary Examiner*—Edward K. Look
*Assistant Examiner*—James A. Larson
*Attorney, Agent, or Firm*—Burns, Doane, Swecker & Mathis

[57] ABSTRACT

An axial-flow turbine has at least one row of bowed guide vanes (7) and at least one row of rotor blades. The bowing of the guide vanes (7) over the vane height is selected at right angles to the chord and is directed towards the pressure side of the respectively adjacent guide vane in the peripheral direction. The guide vanes are tapered in their radial extent. Secondary losses, which occur due to the deflection of the boundary layers in the guide vanes, are reduced by this measure.

5 Claims, 3 Drawing Sheets

AXIAL-FLOW TURBINE

BACKGROUND OF THE INVENTION

1. Field of the Invention

The invention relates to an axial-flow turbine with at least one row of bowed guide vanes and at least one row of rotor blades.

Bowed guide vanes are, in particular, employed in order to reduce the secondary losses which occur due to the deflection of the boundary layers in the guide vanes.

2. Discussion of Background

Turbines with bowed guide vanes are known, for example, from DE-A-37 43 738. In this publication, vanes are shown and described whose bowing over the vane height is directed towards the pressure side of the respectively adjacent guide vane in the peripheral direction. Also known from this publication are vanes whose bowing over the vane height is directed towards the suction side of the respectively adjacent guide vane in the peripheral direction. This is intended to reduce both radial boundary layer pressure gradients and boundary layer pressure gradients extending in the peripheral direction in an effective manner and, in consequence, to reduce the aerodynamic blading losses. To whichever side of the adjacent vane the bowing of this known vane is directed, it extends precisely in the peripheral direction in each case. This means that in the case of the cylindrical vanes represented, their leading edges at least are located in the same radial plane over the height of the vane.

SUMMARY OF THE INVENTION

Accordingly, one object of the invention is to provide a novel measure, in an axial-flow turbine of the type mentioned at the beginning, by means of which the losses quoted can be further reduced.

In accordance with the invention, this is achieved by selecting the bowing of the guide vanes over the height of the vane at right angles to the chord and by tapering the guide vanes in their radial extent. At the same time, the bowing should be directed towards the pressure side of the respectively adjacent guide vane in the peripheral direction.

The advantage of the invention may be particularly seen in the fact that because of the bowing at right angles to the vane chord, the vane area projected in the radial direction is larger than in the case of the known bowing in the peripheral direction. This increases the radial force on the working medium; the latter is pressed onto the duct walls so that the boundary layer thickness is reduced.

In axial-flow turbines with an at least approximately cylindrical vane carrier contour in the region of the guide vane roots, at the outer diameter of the guide vane, and a conically opening hub contour in the region of the guide vanes tips, at the inner diameter of the guide vanes, such as are used, for example, in single-stage gas turbines of exhaust gas turbochargers, it is advantageous for the guide vanes to be twisted over the vane height. The combination of bowing and twist permits optimization of the degree of reaction over the vane height without, in the process, making it necessary to change the distribution of the inlet angle to the rotor blades greatly. A further advantage may therefore be seen in the fact that in the design of a turbine stage, the previous rotor blades can be taken over just as they are.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which represent an exemplary embodiment of the invention using a single-stage exhaust gas turbocharger with axial/radial outlet and wherein.

DESCRIPTION OF THE PREFERRED EMBODIMENTS

Figure 2:
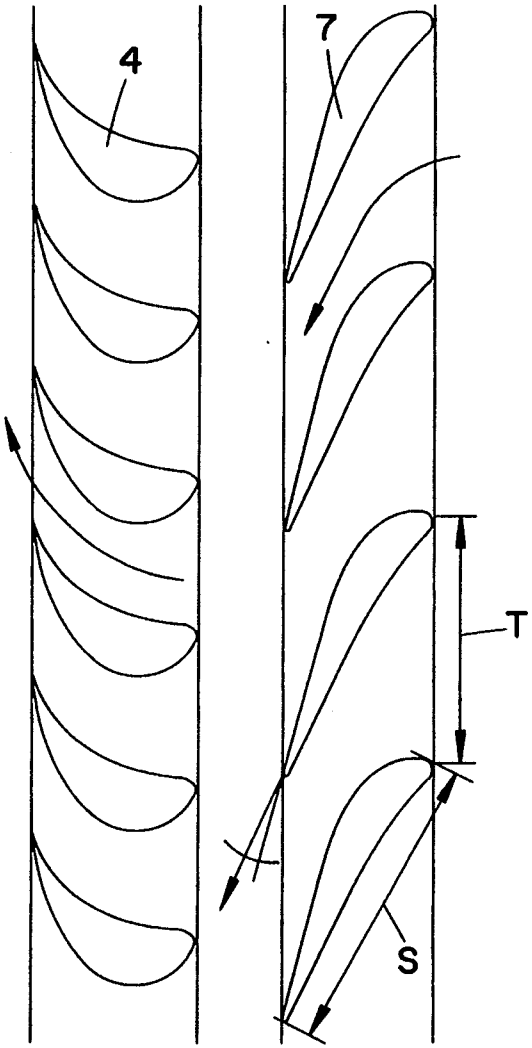
FIG. 2 shows the partial development of a cylindrical section on the outer diameter of the flow duct shown in FIG. 1.

Referring now to the drawings, wherein like reference numerals designate identical or corresponding parts throughout the several views, only the elements essential to understanding the invention are shown. Of the installation, the compressor part, the casing, the rotor, together with bearings etc, for example, are not shown. The flow direction of the working medium is indicated by arrows.

Figure 1:
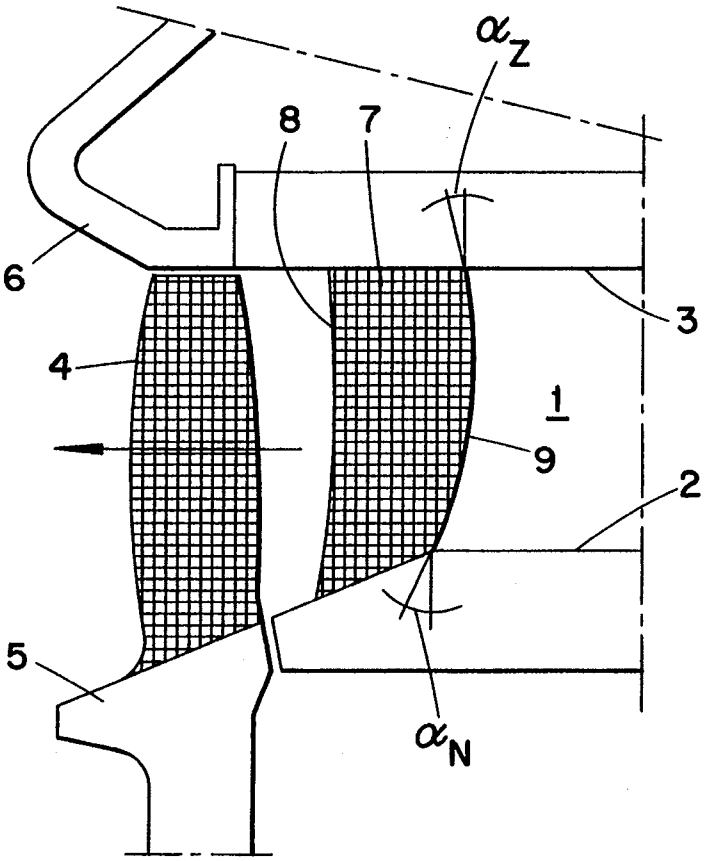
FIG. 1 shows a partial longitudinal section of the turbine.

In the gas turbine shown diagrammatically in FIG. 1, the walls bounding the flow duct 1 are the inner hub 2, on the one hand, and the outer vane carrier 3, on the other. The latter is supported in a suitable manner in the casing (not shown). In the region of the rotor blades 4, the duct 1 is bounded at the inside by the rotor disk 5 and at the outside by the cover 6. The hub 2 is configured conically, and specifically so that the cone opens up, in the whole of the blading region because of the increase in volume of the expanding working medium.

A stationary guide vane cascade is arranged upstream of the rotor cascade. Its vanes 7 are optimized for full load—with respect to fluid mechanics—in terms of their number and their ratio of chord S to pitch T (FIG. 2). They provide the flow with the swirl necessary for entry into the rotor cascade. As a departure from the diagrammatic representation, this guide cascade is usually manufactured as a whole, including its outer and inner boundary walls, for example as a nozzle ring cast in one piece. It is not therefore actually possible to refer to vane tip or vane root. In the following description, the root of the vane guide is understood as being positioned at the outer diameter of the vane, that is, in the vane carrier 3, and the vane tips as being positioned at the inner diameter, that is, at the hub 2.

Figure 3:
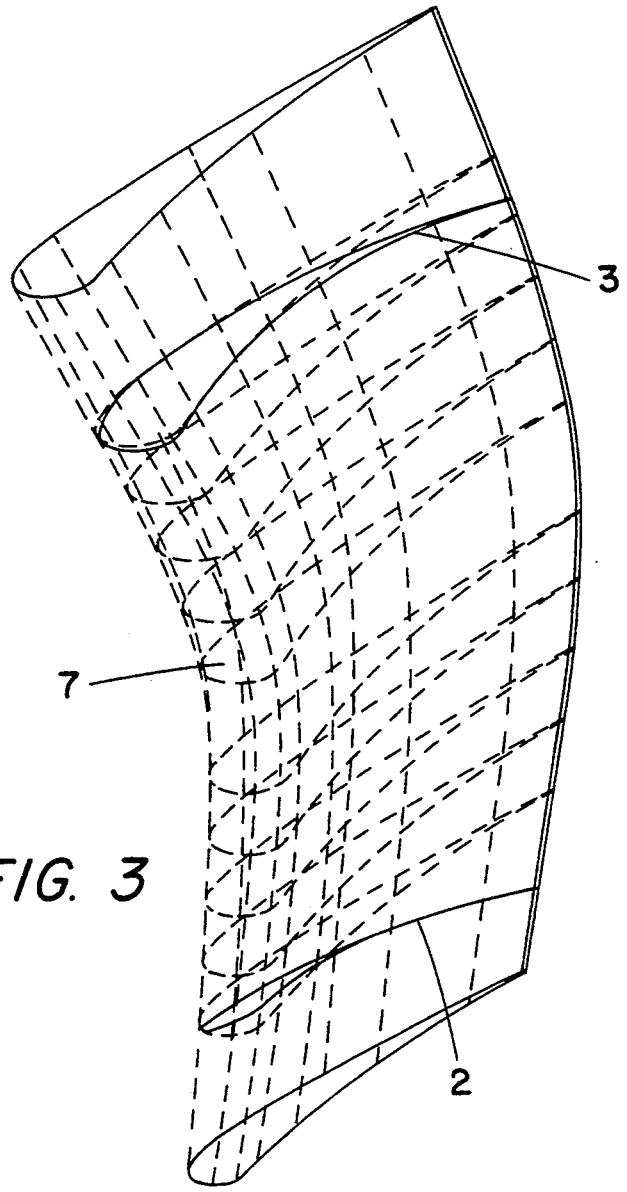
FIG. 3 shows, in perspective, the skeleton of a bowed guide vane.

It may be seen from FIG. 1 and 3 that because of the vane bowing, neither the inlet edge 9 nor the outlet edge 8 of the guide vanes are located in one and the same axial plane.

The bowing of the vanes extends at right angles to the chord and this is achieved by a displacement of the profile sections in both the peripheral direction and the axial direction.

The bowing is formed by a continuous arc which forms the acute angle $\alpha_Z$ with the vane carrier 3 and the acute angle $\alpha_N$ with the hub 2. The angle $\alpha_Z$ at the outer diameter is made smaller than the angle $\alpha_N$ at the inner diameter. The angles represented in FIG. 1 are not, as such, to be considered as being in the axial plane but, rather, at right angles to the chord plane of the vane.

The guide vanes are tapered radially inwards. The taper is selected in such a way that the guide vane is configured with an increasing ratio of chord to pitch from the outer radius to approximately half the vane height and is configured with an approximately constant ratio of chord to pitch from half the vane height to the inner radius. The vane profile remains substantially unaltered over the height of the vane.

Figure 4:
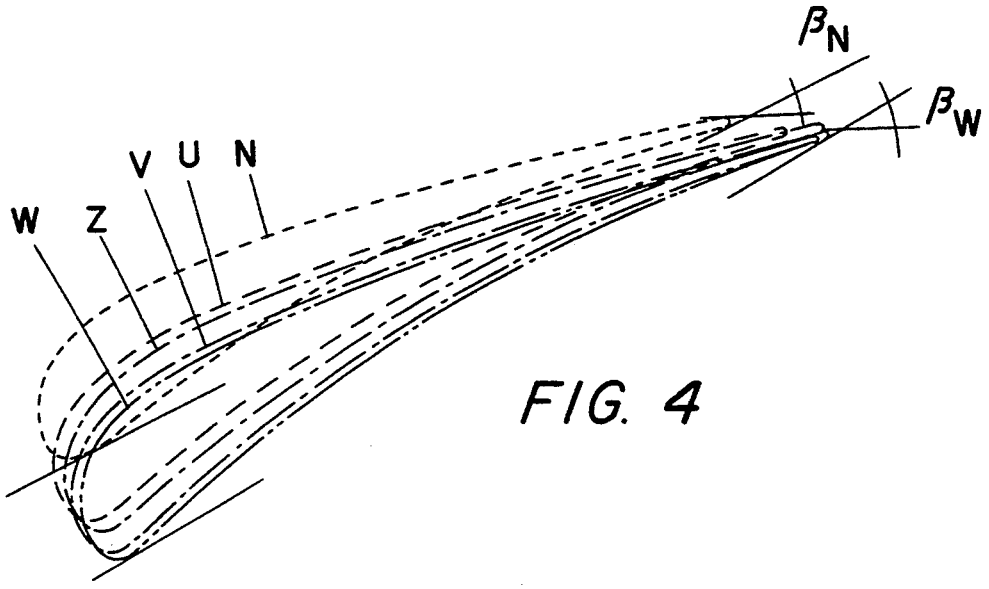
FIG. 4 shows profile sections of a bowed guide vane.

The amount of the bowing and the taper, together with the vane profiles, can be seen from FIG. 4. In this, five profile sections, which are at least approximately equidistant over the height of the vane, may be seen in a radial view. Z indicates the profile at the outer diameter, i.e. at the cylinder, N indicates that at the inner diameter, i.e. at the hub, and V indicates the profile at half the vane height, whereas U and W indicate two further profiles at $\frac{1}{4}$ and $\frac{3}{4}$ of the vane height respectively.

These measures contribute to the desired unloading of the boundary zones.

In addition to the bowing and taper, twisting of the vane aerofoil is also undertaken over the airfoil length of the guide vane in order to make allowance for the change in the peripheral velocity, over the duct height, of the rotor blades which follow the guide vanes. In FIG. 4, the twist is shown in the form of different stagger angles, $\beta_N$ and $\beta_W$ respectively, which the chords of the corresponding profiles N and W make with the peripheral direction. Without guide vane twist, it would be necessary to match the inlet angles of the rotor blades to the outlet angles of the guide vanes. This would in turn result in an undesirable change to the swallowing capacity of the turbine.

The cylindrical section in FIG. 2 shows the blading diagram in the turbine zone considered to an increased scale. At full load, the exhaust gases usually leave the guide vanes at an angle of approximately 15° to 20°. In particular the deviation of the gas outlet angle from the outlet angle of the vane trailing edge due to the effect of the boundary layer at the outer duct wall is recognizable.

Figure 6:
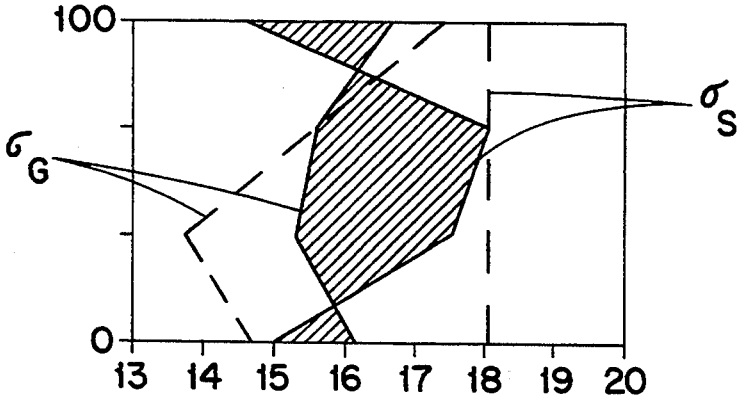
FIG. 6 shows a diagram comparing the gas outlet angles and vane outlet angles over the duct height.

This matter of boundary zone unloading is explained in the diagram of FIG. 6. In this, the outlet angle is plotted in [°] on the abscissa and the duct height in the region of the guide vane trailing edge is plotted in [%] on the ordinate.

The gas outlet angles $\sigma_G$ and vane outlet angles $\sigma_S$ over the duct height for conventional, cylindrical guide vanes are compared with those of vanes three-dimensionally bowed according to the criteria of the invention. The values shown in interrupted lines apply to the cylindrical vanes; the very irregular distribution of the gas outlet angle $\sigma_G$ over the height of the vane for a constant vane outlet angle $\sigma_S$ can be clearly recognized. The kink in the curve in the hub region, at which the vane pitch is small, may be attributed to the transonic flow present there. The full lines, which apply to bowed vanes, show a relatively constant gas outlet angle $\sigma_G$ over the vane height. Although the vanes are turned in at the casing and at the hub, i.e. are provided with smaller vane outlet angles $\sigma_S$, the important gas outlet angles $\sigma_G$ in the boundary zones are larger than those in the center of the vane. The excess velocities at the hub, mentioned above, do not occur when the new measures are used.

Figure 5:
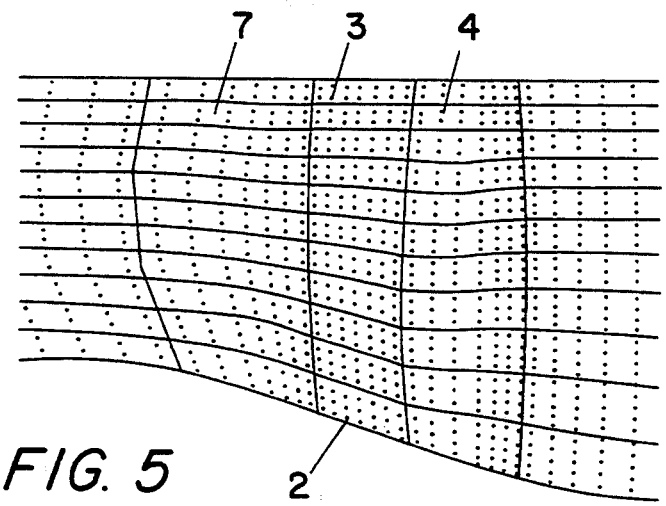
FIG. 5 shows meridional streamlines in an axial section.

This unloading of the boundary zones causes a displacement of the meridional lines radially outwards towards the vane carrier wall and radially inwards towards the hub wall, as is illustrated in FIG. 5.

The radial component exerted on the flow consequently has the intended effect of pressing the flow onto the hub and onto the cylinder.

Because the outlet edges 8 of the guide vanes are not located in one and the same axial plane, the wakes do not extend radially either. This can possibly have advantageous effects on the vibration excitation of the rotor blades 4 which are arranged downstream.

Figure 7:
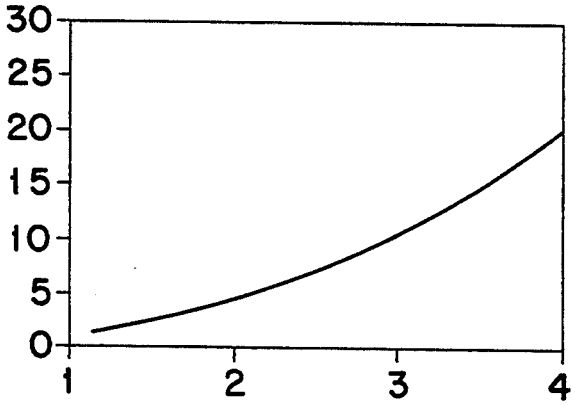
FIG. 7 shows a diagram giving the reduction in loss as a function of the turbine pressure ratio.

The diagram of FIG. 7, in which the turbine pressure ratio is plotted in [bar] on the abscissa and the pressure loss reduction in [%] is plotted on the ordinate, shows how the measure has advantageous effects with increasing pressure ratio.

Obviously, numerous modifications and variations of the present invention are possible in light of the above teachings. It is therefore to be understood that within the scope of the appended claims, the invention may be practised otherwise than as specifically described herein. As a departure from this description, the bowing of the guide vanes can also be directed towards the suction side of the respectively adjacent guide vane in the peripheral direction. In contrast to the solution described, in which the boundary layers are accelerated on the cylinder and on the hub, the boundary layers are not then affected but, rather, the bowing has positive effects on the core flow.

What is claimed as new and desired to be secured by Letters Patent of the United States is:

1. An axial-flow turbine with at least one row of bowed guide vanes and at least one row of rotor blades, wherein the bowing of the guide vanes over the height of the vane is selected at right angles to a vane chord and wherein the guide vanes are tapered in their radial extent.

2. The axial-flow turbine as claimed in claim 1, wherein the bowing of the guide vanes is directed towards a pressure side of a respectively adjacent guide vane in a peripheral direction.

3. The axial-flow turbine as claimed in claim 1, wherein the taper is selected in such a way that the guide vane is configured with an increasing ratio of chord to pitch from an outer radius to approximately half the vane height and is configured with an approximately constant ratio of chord to pitch from half the vane height to an inner radius.

4. The axial-flow turbine as claimed in claim 1 further comprising a conical opening hub part in the region of an inner diameter of the vanes, and wherein the guide vanes are twisted over the blade height.

5. The axial flow turbine as claimed in claim 4, wherein the twist of the guide vanes comprises varying the angle of the vane chord relative to the peripheral direction over the height of the guide vanes.

* * * * *